US005440425A

United States Patent [19]

Kadooka et al.

[11] Patent Number: 5,440,425

[45] Date of Patent: Aug. 8, 1995

[54] REARVIEW MIRROR WITH HEATER FOR DEFROSTING AND DEFOGGING

[75] Inventors: Humberto T. Kadooka; Ricardo P. Moreno; Olavo N. Da Costa, all of no Estado de Sao Paulo, Brazil

[73] Assignee: Metagal Industria E Commercio LTDA, Sao Paulo, Brazil

[21] Appl. No.: 85,013

[22] Filed: Jun. 29, 1993

[51] Int. Cl.[6] ..... H05B 3/84

[52] U.S. Cl. ..... 359/512; 219/219; 219/548

[58] Field of Search ..... 359/512, 507, 883; 219/219, 548, 543

[56] References Cited

U.S. PATENT DOCUMENTS 5,198,639 3/1993 Smuckler ..... 219/219

5,206,482 4/1993 Smuckler ..... 219/219

*Primary Examiner*—Loha Ben

*Assistant Examiner*—James Phan

*Attorney, Agent, or Firm*—Michael J. Striker

[57] ABSTRACT

The rearview mirror consists of a base attached to a motor vehicle; a supporting structure attached to the base, a mirror plate held in the supporting structure, and a self-controlled heater for defrosting and defogging located between the mirror plate and the supporting structure. The self-controlled heater includes a polymeric semiconductor substrate containing a conductive lampblack, a conductor track including a plurality of electrically conductive bands made with silver ink printed on the semiconductor substract and a terminal for each conductive band. The conductive track has interpenetrating portions spaced at intervals from each other and structured and dimension to provide sufficient heat transfer for defogging and defrosting the mirror plate.

5 Claims, 1 Drawing Sheet

REARVIEW MIRROR WITH HEATER FOR DEFROSTING AND DEFOGGING

CROSS-REFERENCES

Reference is made to the copending U.S. patent Applications filed by the above same inventors entitled "SEMICONDUCTOR POLYMERIC COMPOUND BASED ON LAMPBLACK, POLYMERIC SEMICONDUCTOR BODY, AND METHODS OF MAKING THE SEMICONDUCTOR POLYMERIC COMPOUND AND THE POLYMERIC SEMICONDUCTOR BODY" and "METHOD OF MAKING A SELF-CONTROLLED HEATER AND IMPROVED SELF-CONTROLLED HEATER MADE THEREBY".

BACKGROUND OF THE INVENTION

The present invention relates to a rearview mirror for a motor vehicle.

Rearview mirrors for automobiles are known and consist essentially of a mirror plate, mounted so that it can be adjustably positioned or not in a frame or other supporting structure, which is mounted so that it can be adjusted or not on a base, which is attached, in the case of an external rearview mirror, to a side of the automobile and, in the case of a internal rearview mirror, to the region of the ceiling close to the middle of the windscreen.

Despite the efficiency of current rearview mirrors, they have the disadvantage that, particularly during cold days and/or days with a high level of humidity and/or fog, the rearview mirror becomes coated with moisture, thus diminishing and sometimes completely eliminating the view provided by the rearview mirror. This is particularly a problem for external type rearview mirrors.

The above-identified copending U.S. patent applications describe a semiconductor polymeric compound and a method of making a heater based on it which are useful in overcoming this disadvantage. The disclosure of these copending applications should be considered as being incorporated herein by reference.

SUMMARY OF THE INVENTION

It is an object of the present invention to provide an improved rearview mirror which does not have the disadvantage described hereinabove.

According to the present invention, the rearview mirror comprises a reflective mirror plate having defogging and defrosting means consisting of a self-controlled heater mounted on the rear of the mirror plate of the rearview mirror. This heater is based on the polymeric semiconductor compound based on lampblack described in the first of the copending application referred to above and is described and claimed in the second of the copending applications. It can be advantgeously applied to a rear surface of the mirror plate with an adhesive means.

The highly efficient defogger and defroster means of the present invention properly solves the problem described above without interfering with the efficiency of the rearview mirror or without making the mirror too expensive.

Another advantage is that the present defogger and defrosting means is easy to include in the rearview mirror and does not require substantial modifications of the assembly line.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENT

Figure 1:
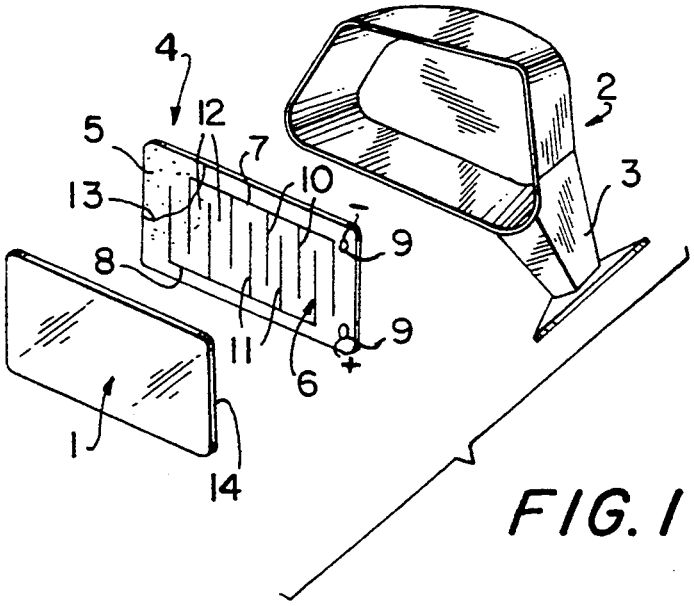
FIG. 1 is an exploded perspective view of a rearview mirror according to the invention having a defogger and defroster means.
Figure 2:
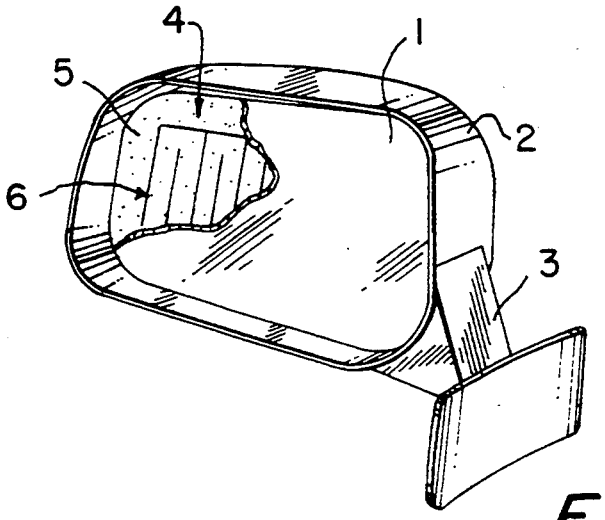
FIG. 2 is a partially cutaway perspective view of the rearview mirror shown in FIG. 1.

An externally mounted rearview mirror according to the invention with defogging and defrosting means 4 is shown in FIG. 1 and 2. It comprises a base 3 attached to the body of a motor vehicle, e.g. an automobile, and frame or support structure 2 rigidly attached to the base 3 and a reflective mirror plate 1 dimensioned and structured so that it can be held and attached to the support means or frame 2.

The mirror plate 1 is provided with a defogger and defroster 4 consisting of a self-controlled heater made as described in the preferred embodiments of the copending applications referred to hereinabove, i.e. from a polymeric semiconductor compound based on lampblack with at least one silver printed electrical conductive tracks printed thereon.

The self-controlled heater in a preferred embodiment has a silver printed electrical conductive track and a semiconductor plate on which the track is applied. The semiconductors plate consists essentially of a substrate consisting essentially of about 60% by weight of low density polyethylene, of about 8.5% by weight ethylene vinyl acetate copolymer, of about 4.0% by weight of a spreading agent consisting of calcium stearate, of about 3.0% by weight of an antioxidant and about 0.5% by weight of a coupling agent consisting of calcium titanate as well as conductive lampblack. The substrate contains about 20% by weight of a porous lampblack consisting of a plurality of lampblack agglomerations having a comparatively low degree of orientation with a high degree shearing. The heater consists of a substrate 5 having at least two terminals 9 thereon and a silver ink conductor track 6 printed thereon consisting of bands including at least one negative pole 7 and at least one positive pole 8 each connected to one of the terminals 9. The preferred embodiment has one negative pole 7, one positive pole 8 and two terminals 9. The negative and positive poles 7,8 have interpenetrating adjacent parts 10,11 having intervals 12 between them. These components 7,8 are dimensioned and structured to provide proper heat transfer to the mirror plate 1 itself which is to be defogged and/or defrosted.

Furthermore a suitable adhesive layer 13 is provided between the substrate 5 and a rear surface 14 of the mirror plate 1 to secure the self-controlled heater to the rear surface 14 of the mirror plate 1. This adhesive layer 13 must be made of an adhesive which is not affected by the temperatures and heat in operation.

The defogging and defrosting means described above have variable configurations, dimensions and heat dissipation capacities which are suitable for different configurations and dimensions of current rearview mirrors.

While the invention has been illustrated and described as embodied in an improved rearview mirror, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. Rearview mirror for a motor vehicle, said rearview mirror consisting of a base (3); a mirror plate (1); supporting means (2) for holding said mirror plate (1), said supporting means (2) being rigidly attached to said base (3) and holding said mirror plate (1); and defogging and defrosting means for defogging and defrosting said mirror plate (1), said defogging and defrosting means consisting of a self-controlled heater located between said mirror plate (1) and said supporting means (2), wherein said self-controlled heater comprises a polymeric semiconductor substrate (5) including a porous conductive lampblack and an electrical conductor track (6) printed on said semiconductor substrate (5), said electrical conductor track (6) being made from a silver ink;

wherein said polymeric semiconductor substrate consists essentially of about 60% by weight of low density polyethylene, of about 8.5% by weight ethylene vinyl acetate copolymer, of about 4.0% by weight of a spreading agent consisting of calcium stearate, of about 3.0% by weight of an antioxidant of about 0.5% by weight of a coupling agent consisting of calcium titanate and of about 20% by weight of said porous conductive lampblack.

2. Rearview mirror as defined in claim 1 further comprising at least two terminals (9) on said substrate (5), and wherein said conductor track (6) includes at least one positive pole (S) and at least one negative pole(7);

wherein said at least one positive pole is electrically connected to one of the at least two terminals and said at least one negative pole is electrically connected to another of the at least two terminals, and said at least one positive pole (8) and at least one negative pole (7) have interpenetrating and adjacent portions (10,11) spaced at intervals (12) from each other so that in operation a sufficient amount of heat is provided to said mirror plate (1) for defogging and defrosting said mirror plate (1).

3. Rearview mirror as defined in claim 2, further comprising adhesive means (13) for securing said substrate (5) to said mirror plate (1).

4. Rearview mirror as defined in claim 2, having only two of said at least two terminals (9).and wherein said conductor track (6) consists of only one of said at least one positive pole and only one of said at least one negative pole.

5. Rearview mirror for a motor vehicle, said rearview mirror consisting of a base (3) a mirror plate (1); supporting means (2) for holding said mirror plate (1), said supporting means (2) being rigidly attached to said base (3) and holding said mirror plate (1); and defogging and defrosting means for defogging and defrosting said mirror plate (1), said defogging and defrosting means consisting of a self-controlled heater located between said mirror plate (1) and said supporting means (2), wherein said self-controlled heater consists of an extruded polymeric semiconductor substrate (5) comprising a porous conductive lampblack, low density polyethylene and ethylene vinyl acetate copolymer; an electrical conductor track (6) printed on said semiconductor substrate (5), said conductor track being made from a silver ink, and terminals (9) connected to the electrical conductor track (6).

* * * * *